United States Patent [19]

Akatsu

[11] Patent Number: 4,838,356

[45] Date of Patent: Jun. 13, 1989

[54] FIRE EXTINGUISHER FOAM CHAMBER WITH REMOTE MAINTENANCE AND TESTING FOR OIL TANKS

[75] Inventor: Yukio Akatsu, Tokyo, Japan

[73] Assignee: Tokyo Bosai Setsubi Company, Limited, Tokyo, Japan

[21] Appl. No.: 33,268

[22] Filed: Apr. 2, 1987

[30] Foreign Application Priority Data

Apr. 17, 1986 [JP] Japan ..... 61-87139

[51] Int. Cl.[4] ..... A62C 35/56

[52] U.S. Cl. ..... 169/66; 73/863.86

[58] Field of Search ..... 169/66–68, 169/13–15, 23, 19, 5, 44; 137/556, 887; 73/863.86, 863.81, 40.7, 40.5 R, 49.1; 116/272, 273, 277

[56] References Cited

U.S. PATENT DOCUMENTS

| | | | |
|---|---|---|---|
| 340,864 | 4/1886 | Darrach | 169/66 X |
| 1,200,640 | 10/1916 | Morris | 116/272 |
| 1,201,894 | 10/1916 | Thompson | 116/277 X |
| 2,519,303 | 8/1950 | Whitehouse | 73/863.86 X |
| 2,553,293 | 5/1951 | Bedford | 169/66 |
| 2,576,737 | 11/1951 | Wendel | 137/887 X |
| 2,618,346 | 11/1952 | Bedford et al. | 169/66 |
| 4,569,366 | 2/1986 | West et al. | 116/277 X |

FOREIGN PATENT DOCUMENTS

| | | | |
|---|---|---|---|
| 217705 | 5/1957 | Australia | 137/556 |
| 458831 | 8/1949 | Canada | 169/66 |
| 932486 | 8/1955 | Fed. Rep. of Germany | 169/5 |
| 847182 | 10/1939 | France | 169/66 |
| 229987 | 3/1944 | Switzerland | 169/66 |
| 335949 | 3/1959 | Switzerland | 169/66 |

*Primary Examiner*—Sherman D. Basinger
*Assistant Examiner*—James M. Kannofsky
*Attorney, Agent, or Firm*—Waldron & Associates

[57] ABSTRACT

Function and integrity testing of remotely controlled and automatic foam generating fire suppression equipment is provided. By remote systems, the entire functionality of such installations can be assessed without the requirement for direct physical access commonly required for such equipment. In addition, the seals employed in the system to isolate the fire extinguishing equipment from the protected environment are subjected to non-destructive testing, providing for protection of the environment from the testing procedure, as by the release of the generated foam.

8 Claims, 5 Drawing Sheets

FIRE EXTINGUISHER FOAM CHAMBER WITH REMOTE MAINTENANCE AND TESTING FOR OIL TANKS

SPECIFICATION

1. Brief Summary

This invention relates to a multiple remote testing system of a foam extinguishing system for oil storage tanks. A special sealing cap is provided which allows automatic resealing without manual intervention after a foaming test is completed, or after the actual use of the extinguishing system. A function tester is provided which allows the direct, remote inspection of foam produced during testing. Contamination of the oil tank during this process is avoided by the provision of a ball valve system. Also provided is a foam leak detection system which is used prior to foam testing to assure that the oil tank is completely sealed off from the foaming unit during the testing process.

2. Background of the Invention

Fires which occur in oil tanks are of a particularly severe and dangerous variety. Because of the enclosed structure of modern oil tanks, such fires can start without being detected by visual scrutiny of the exterior of the tanks. This poses special problems in providing for oil tank safety. Additionally, oil tanks tend to be located in large complexes which are in relative isolation from human attendants. Therefore, constant direct observation of each tank is difficult in any case.

Fires in oil tanks progress very rapidly due to the highly volatile nature of the petrochemicals being stored therein. When such a fire exceeds the tank in which it was originally confined, it will often spread rapidly to neighboring tanks. Once such an oil tank fire becomes established, it is often beyond control. As a result, the entire adjoining facility can be lost.

The violent nature of the infernos which can occur in oil tank yards makes such accidents extremely dangerous. The uncontrolled combustion of large stores of oil can lead to severe pollution problems. Despite the isolation of most oil tank facilities, there is also the possibility that the fires can spread to neighboring areas. The loss of oil stocks, industrial equipment and buildings results in substantial financial loss.

For these reasons, most countries have enacted laws requiring the fitting of all oil storage tanks with fire extinguishing systems which will activate automatically at the first indication of a fire. Because of these requirements in conjunction with the economic interests of oil storage companies, apparatuses for automatically extinguishing fires in oil tanks have long been known in the art.

One of the most successful of these prior art methods is the use of foam chambers adjacent to the oil tank which automatically generates foam at the first stage of a fire. The foam is directed onto the surface of the oil in the tank. This extinguishes any incipient flame, and avoids the spread of the fire to the remainder of the oil surface.

The effect of the treatment of the oil surface with extinguishing foam is to hermetically seal the oil surface. This quenches the combustion process by making oxygen unavailable to the fire. The foam serves generally to suppress and extinguish the fire. The water component of the foam provides a cooling effect. Once the fire is suppressed by the foaming method, there is a considerably lessened risk of rekindling.

The conventional, prior art foam extinguishing system consists of communicating pipelines which allow the combination of water, gas and a foaming substance, and then direct the resulting foam into the tank. A foam chamber is often provided which allows the foam to develop fully after water, gas and foaming chemicals are combined. A conduit pipe is provided to direct the developed foam into the oil tank.

An easily breakable seal, such as one made of glass, has been used in the prior art as a cap over the pipe into which the water, air and foaming chemical will be flowing in the case of a fire. The cap is provided between this pipe and the foam chamber. When fire conditions result in increasing the pressure of foaming solution and air into the supply pipe by activation of the system pumps, the sealing plate breaks. The breakage with the resulting opening of the pipeline allows the process of foam generation and application of the foam to the surface of the oil to take place automatically.

Until it is broken, the seal also protects the water, the foam solution, and foaming chemical supply conduits from contamination with dust or dirt and gas vapor coming from the oil tank. During fire conditions, the cap protects the extinguishing system foam supply pipe lines from water pressurized by the burning process until it is broken to release the extinguishing foam. After breakage, if the pressure of the gases exceeds those of the extinguishing foam, the gases may harm the extinguishing system. There may even be the escape of pressurized oil by backflushing through the extinguisher system foam supply pipe line.

The success of such systems depends on the extinguishing systems being able to function effectively in an emergency, and also on its ability to generate sufficient amounts of the extinguishing foam. Because such systems may lose their reliability over time or due to environmental or other factors, functional tests and inspection of the extinguishing systems are undertaken on a regular basis. These tests are often required by law.

The prior art functional tests and inspection for foam extinguishing systems require substantial effort and expense. The inspection and tests must be preceded with the building of a temporary scaffold. The scaffolding is necessary to allow workers to reach the automatic extinguishing system. The foam chamber is then disengaged, and a test nozzle and foam shooter are connected to the chamber. The ability of the system to effectively produce extinguishing foam is then tested outside of the oil tank by a foam shooting test. The various parts of the extinguishing system are then cleaned and reassembled.

These manual testing methods have several disadvantages. The construction of the scaffolding required for the inspection is time consuming. The inspection and testing is usually conducted at the top of 6 to 10 meter scaffolding. Mechanical manipulations by workers at such heights entail risks of injuries due to accidental falls.

There is also a risk that the manual inspection process itself may set off an explosion of combustible gases which may back-flow from the oil tank through the foam supply pipe line to the system. Such explosions can be set off by the static electricity generated during the inspection process, or by sparks which may occur when metal tools or disengaged metal parts strike the metal structures of the tank.

Thus, there is considerable disincentive to conduct regular inspections of fire extinguishing system installations on oil tanks. The proper function of these mechanisms is important from both safety and economic standpoints. As a result, there is a need in the art for a more inexpensive, safe and reliable method of testing the function of an foam fire extinguishing system for oil tanks.

The prior art sealing caps mentioned above do not lend themselves to remote testing of foam type extinguishing systems, and have other limitations as well. The prior art sealing structures are designed to break easily in either an emergency situation or during an extinguishing system function test. In fact, this destruction is a necessary aspect of the function of the prior art caps. A prior art cap which is not destroyed when the extinguishing system is activated would result in the nonfunctioning of the system.

As a result, the caps of the prior art must be removed and replaced after accidental system activation, accidental cap breakage, emergency activation, and testing situations when cap breakage occurs. The prior art has made some accommodations for this limitation. For instance, in U.S. Pat. No. 1,754,005 access to the cap without complete dismantling of the tank roof and mixing head is made possible by a hand-hole which is normally closed by a hand-hole plate (column 2, lines 92–98).

The prior art provides for impervious brittle material sealing caps made of glass, ceramics or plastic. Several advances have been made in the construction of such seals. For instance, U.S. Pat. No. 2,618,346 teaches that by reinforcing the central area of the cap, the complete separation of the cap center from the clamped areas is facilitated upon activation of the system.

Efforts have also been made to allow the breakage of the seal by conscious decision, as in the case when the spread of a fire to a tank is eminent, and protection is required. U.S. Pat. No. 2,202,176 provides for a second pressure means for breaking the sealing cap. U.S. Pat. No. 2,603,298 provides for the use of a solid plunger to break the seal. However, in such systems, the cap would later require replacement. The extinguishant supply pipeline could not be practically re-capped at the time of breaking to avoid backflush contamination of the system.

Conventional sealing plates have been easily damaged by vibration, jarring, or piping deformation which can occur during storms or earthquakes. The combustible gas in the oil tank may then backflush into the pipe lines due to the construction of the system and the tank. If such an accidental breakage occurs without timely detection, contamination and resulting dysfunction of the foam extinguishing system can occur. If the cap is damaged or does not provide a full seal, the entrance and gradual condensation in the foam chamber of oily vapors from the tank may result. The condensed materials produce a waxy deposit on these structures which can cause clogging of the passages by the buildup material. Additionally, dirt, moisture, and other ambient contaminants can compound the clogging problem. Such contamination can lead to the complete dysfunction of the system in an emergency situation.

Even if the foam extinguishing system manages to function despite the buildup of oily vapors and other materials, there are still disadvantages to the contamination. If the pressure upon activation of the extinguishing system forces such material out of the piping, this condensed material will be thrown on the fire. The throwing of such petrochemical distillates on the fire will only serve to increase its ferocity. If the condensed material does not completely block the passageways, and is not pushed into the fire, it would none the less decrease the efficiency of the system.

Because the integrity of the prior art sealing caps can not be easily observed, severe undiscovered dysfunction of the system can result from cap damage which may not be discovered until the next scheduled test. Accordingly, when the system is not functional or only marginally functional, a dangerous condition arises as a direct result of this limitation of the prior art system.

Other difficulties can result from prematurely broken sealing plates and other undetected deficiencies in the extinguishing system. The prior art provides no remote detection and indicating method by which one can determine that the foaming mechanism is activated and that foam is flowing through the foam supply pipe lines to the oil tank. Thus, foaming mechanisms can be accidentally activated without the operator being able to detect that situation from the exterior of the tank. The foam which then enters the tank can contaminate the oil stored therein. Additionally, the safety and reliability of the extinguishing system will be compromised until the accidental foaming is revealed in the next regular testing session.

Very simple fusible link systems in the prior art did allow visualization of the system activation and fluid application to open-tank fires. Such is taught in U.S. Pat. No. 2,545,154. This prior art patent discloses an unenclosed and unprotected system and accordingly is not applicable in the context of the present invention which is directed to the mechanisms required in foam fire extinguishing systems for closed tanks. It is important that oil fires be contained as much as is possible. Aerial spraying of an open tank is more externally visible than present day techniques. The visibility advantage, however, would be considerably offset by the increased hazard and lack of control of an open tank fire. When the quenching liquid is piped directly to the tank in these older system, the difficulty of observation of fire retardant delivery remains.

Other disadvantages result from the inability to remotely ascertain the flow of foam in the system. During an actual emergency, there is no indication of which extinguishing system on the various tanks are actively producing foam. Thus, emergency personnel have no way to determine which tanks most require additional extinguishing support at the contained phase of a fire. The most effective allocation of fire fighting resources will then be possible only at a much more advanced stage of the fire.

The inability of prior art sealing techniques to provide automatic reclosure of the seal has additional limitations during an emergency situation. The flow of foaming material is not necessarily continuous during the extinguishing of a fire. When the foam is not being rapidly flushed out of the system, there is the danger that gases escaping from the burning oil in the tank or pressurized oil will force themselves back up through the foam supply pipelines and into the extinguishing system. This may occur at times even in the case of reasonably vigorous foam generation if the back flow pressure is sufficiently strong. The result can be a compromise of the function of the system at a most inopportune time.

OBJECTIVES OF THE INVENTION

It is accordingly the object of the present invention to provide an foam fire extinguishing system for oil tanks which can be easily, safely, and inexpensively tested remotely to ensure the readiness of the system for proper operation in the case of a fire.

It is further an object of the present invention to provide a remote testing means integrated with a foam chamber, whereby the foaming capacity, sealing cap regularity and foam leakage of a foam fire extinguishing system can be tested from the ground level.

It is another object of the present invention to provide a sealing plate which is of a movable and resealable type, which will automatically reseal after the testing, use, or accidental opening of the sealing plate.

It is still a further object of the present invention to provide a visual means for ascertaining the open or closed position of the sealing plate from a remote location.

A further object of the present invention is to allow the foaming test to be conducted from ground level, thus eliminating the need for a foam shooter and the used of a temporary scaffold.

FIGURE DESCRIPTIONS

In the detailed description below, reference will be made to the drawing comprised of the following figures.

DETAILED DESCRIPTION

Figure 1:
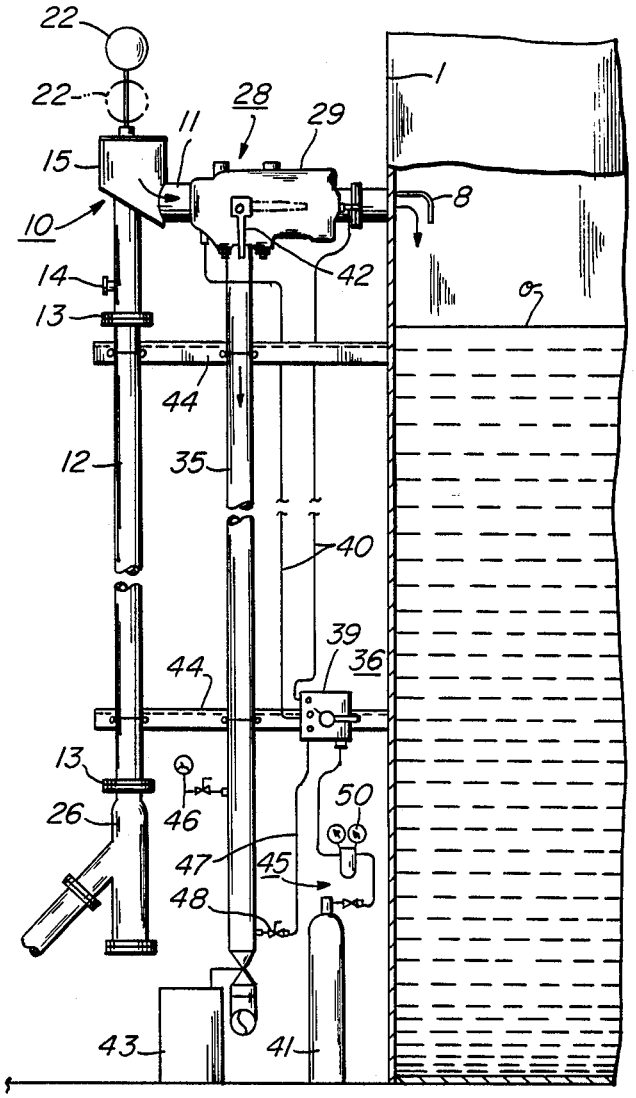
FIG. 1 is an overall view of the inventive foam chamber and remote maintenance system for oil tanks.
Figure 2:
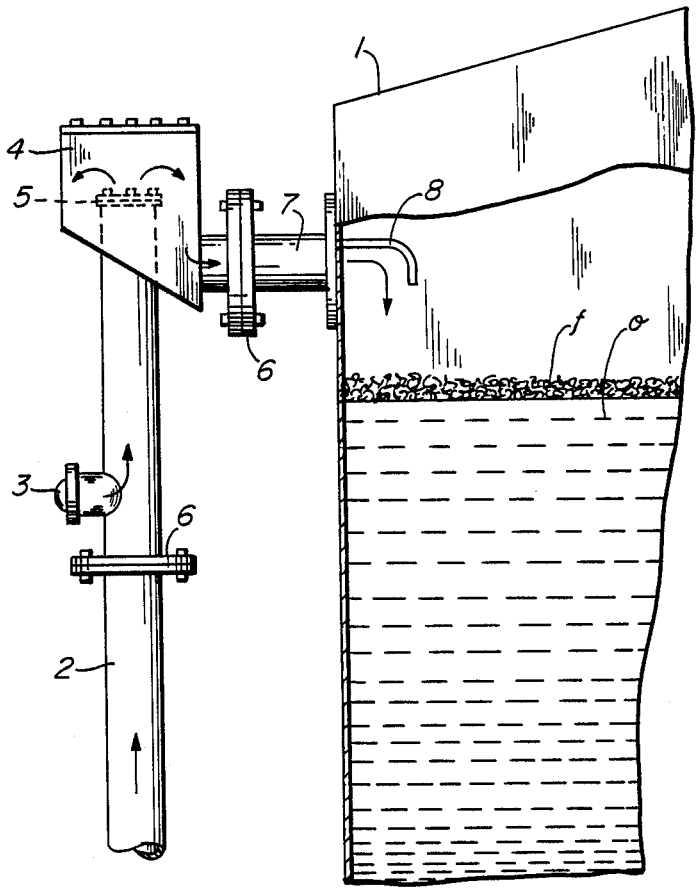
FIG. 2 (PRIOR ART)
FIG. 2 is an overall view of a prior art type foam chamber.

The foam chamber with a remote testing system of oil tank 10 in accordance with the present invention is, in one exemplification, typified by the summary view shown in FIG. 1. FIG. 2 shows a prior art foam chamber which is provided as a reference point to the present invention. Referring now to FIG. 2, an extinguishant supply pipe line 2 is provided with an air inlet 3 and a flange 6. The air and extinguishant, when under pressure during a fire, serve to break the glass sealing plate 5, and then develop into foam in the foam chamber 4. The foam is then delivered into the tank via foam supply pipe line 7, attached to the foam chamber by flange 6, and deflector 8 onto the oil in the oil tank 1. The deflector prevents the foam from splashing by blocking the pressurized foam and letting it slide slowly from the tank's wall onto the oil surface.

In the preferred embodiment of the present invention set forth in FIG. 1, the strainer 26 is provided at the base of the extinguishant supply pipe line 12 to assure that the extinguishant moving from the foam concentrate proportioner 27 (seen in FIG. 7) into the pipeline is free from most solid contaminants. The extinguishant supply pipeline 12, through which the extinguishant travels, is so assembled as to be removable from the flanges 13. The air inlet 14 feeds air into the pipeline 12. This arrangement serves to combine the extinguishant in pipeline 12 with air during the activated phase of the system, producing a suitable mixture for foaming. The extinguishant-air mixture is fed into the foam chamber 15, where the foam is developed and increases in bulk. The foam chamber 15 is a crown box having a chamber for foaming which is situated over the pipeline 12. The foam chamber 15 is so constructed that its bottom portion is slanted to allow the developed foam to flow easily into the foam supply pipe line 11.

Figure 3:
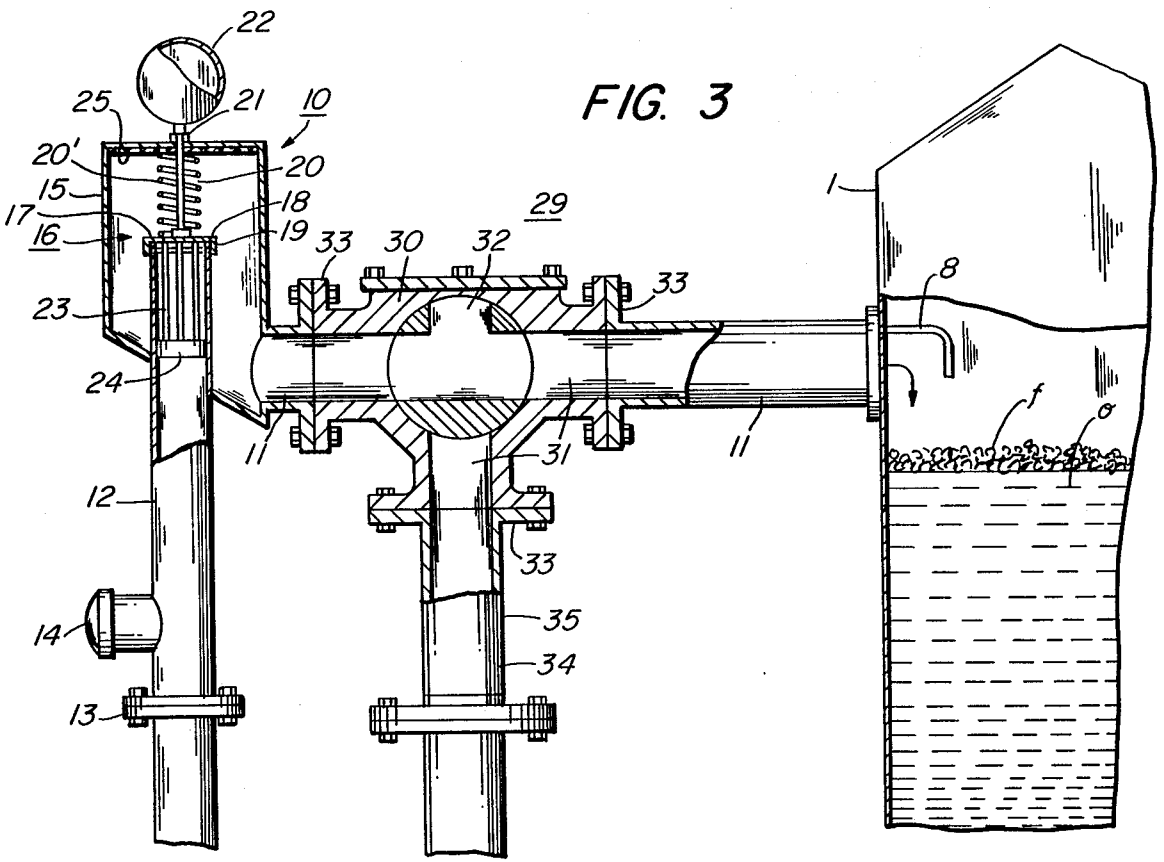
FIG. 3 is a cross-sectional view of the inventive foam chamber with a remote maintenance system for oil tanks.

In a more detailed view in FIG. 3, an automatic opening and closing means 16 is mounted on the top opening of the supply line 12. A brass sealing plate 17 is provided at the top of the supply line 12. A ring-shaped TEFLON sheet 18 and packing 19 are provided between the top of the supply pipe line 12 and the plate 17. The TEFLON ring 18 and packing 19 allow the brass sealing plate 17 to function as a movable cap while limiting risk of sparking by the sharp contact of metal surfaces. The TEFLON ring and packing also serve to provide an effective seal.

The ring 18 and packing 19 minimize the possibility of the sealing plate 17 having damaging or deforming effects on the supply pipe line 12 or the plate 17 itself when the opening and closing means 16 forcefully reseals. A flexible TEFLON sheet 25 is provided at the top of the foam chamber 15. During operation, plate 17 undergoes rapid movement upwards due to direct pressure in its opening phase, the TEFLON sheet 25 protects against sparking and part deformation.

The opening and closing means 16 in is resting state closes the top opening of supply pipe line 12 by means of the weight of the entire automatic opening and closing device, and the action of spring 20', which is situated above the plate 17 in the foam chamber 15. This sealing effect prevents the entry of gas generated in the oil tank 1 from entering the supply pipe line 12, and back flowing out externally during emergency operation. During the occurrence of a fire, the rising pressure of the foam mixture pushes the opening and closing means 16 into an open position. This causes the entrance of the foam extinguishant and air mixture into the foam chamber 15.

A holding rod 20 is provided which is vertically situated between the sealing plate 17 and the bearing 21 located in the roof of the foam chamber 15. A metallic ball 22 constructed of hollow metal is mounted on the tip of the holding rod 20. When the sealing plate 17 is in its open position, this status can be easily ascertained by ground level observation from the raised position of metallic ball 22. The two positions of the hollow metal ball 22 are specifically provided in FIG. 7.

The sign of the raised ball 22 provides remotely situated workers with several pieces of information. During testing or an actual emergency situation, the raised ball 22 indicates that the sealing plate is opened and that the foam solution and air mixture is being properly delivered to the foam chamber. In the case of a fire, the raised ball 22 indicates that the foam is being fed into the oil tank 1 from the foam chamber 15, through the valve assemblage 29, and is not being forced back by tank back pressure.

The raised ball 22 at other times provides further information. It may signal an abnormal increase in pressure in the pipeline 12. It can indicate that the system has been accidentally set off. It may also suggest a mechanical failure resulting in the plate 17 being stuck in the open position despite a lack of opening pressure.

Guide bars 23 are provided which are mounted under the sealing plate 17, and hang down into the supply pipe line 12. The guide bars 23 are fixed to the ring shaped connecting rod 24. This construction of sealing plate 17, guide bars 23, connecting rod 24 serves to suppress the swing which is generated by the vertical motion of the sealing plate 17. The holding action of the bearing 21 also serves to stabilize the position of the plate 17.

A test device 28 as shown in FIG. 1 is provided between the foam chamber 15 and the deflector 8, and it serves to direct the foam into either the oil tank 1 or the foam collector 43. The test device 28 includes a valve assembly 29, shown in detail in FIGS. 3 to 6, and a remote operating unit 36, shown in FIGS. 1 and 7.

The valve assembly 29 (see FIG. 3) consists of a selective valve 30, and an air operated air operated valve shaft 37 in a cylinder 38. The selective valve 30 is a valve body provided with a valve path 31 and an axial turning ball valve 32. The selective valve 30 is connected by flanges 33 to the connecting pipe lines 11 and 35. Pipeline 35 has a flexible portion, 34.

Figure 4:
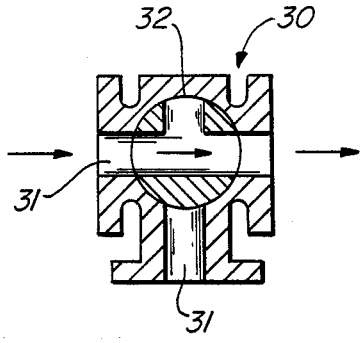
FIG. 4 is a cross-sectional view of the foam diversion valve in its service ready position.
Figure 5:
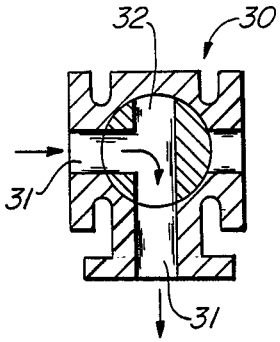
FIG. 5 is a cross-section view of the valve in its foam testing ready position.

As can be seen especially in FIGS. 4 and 5, the ball valve 32 is a 3-way valve which opens and closes the pipe lines by changing the valve path direction by 90 degrees. In the case of FIGS. 3 and 4, the valve 32 is shown in its open position, which allows the foam to feed into the oil tank 1 by way of the valve path. In FIG. 5, the valve 32 is shown in its testing position. There, the valve path is closed to the oil tank 1, so that the foam flow is diverted into the testing pipe line 35 which is vertically connected to the valve 32. In the testing position, no foam enters the oil tank 1.

Figure 6:
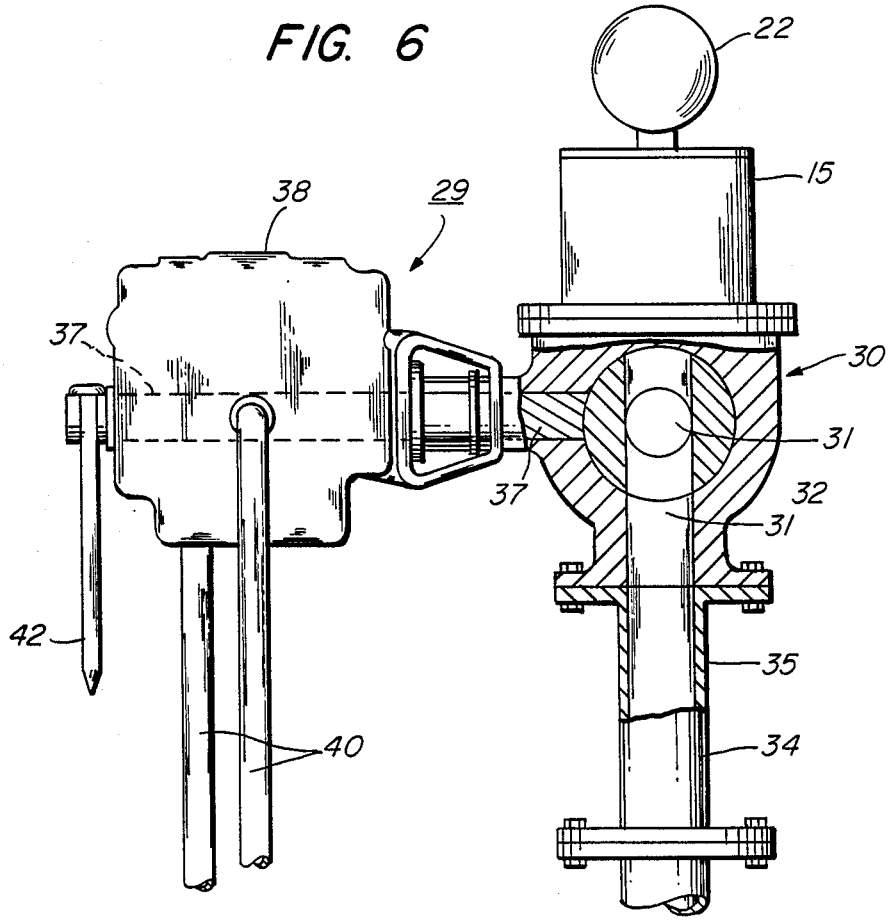
FIG. 6 is a cross-section view of the valve with a pneumatic activator as viewed from the tank looking towards the foam chamber.
Figure 7:
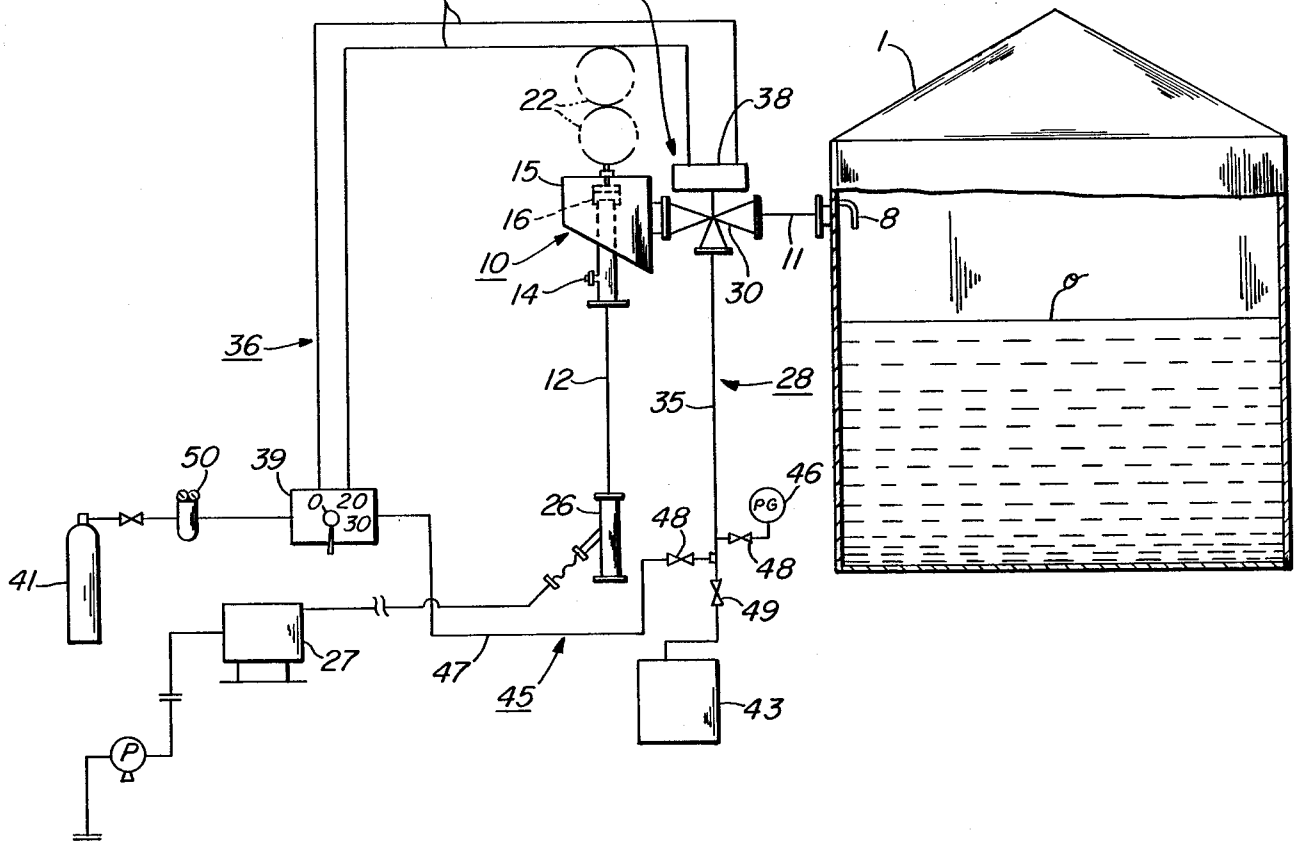
FIG. 7 is a diagram showing the inventive foam chamber with a remote maintenance system for oil tanks.

As shown in FIG. 7, remote operating unit 36 is used to switch the selection ball valve 30 between its testing and operating positions. The remote operating unit 36 directly connects the valve shaft 37 of the ball valve 32 to the pneumatic cylinder 38 as shown in FIG. 6, and serves to turn the valve shaft 37 by 90 degrees by the cylinder operation to open and close the ball valve 32.

The use of air pressure to work the valve 32, rather than the employment of a convention switch system, is a particularly preferred method. The use of an electric switch can cause sparking. Mechanical switching method with exposed working metallic parts also can produce a spark. Sparks are very dangerous around oil tanks and the gases which they often contain.

The present device avoids the disadvantages of accidental sparking. There are very few moving parts. The ball valve 32 is enclosed, so that the chances of producing a spark from its usage is very slight. Further, the reduced number of working parts of the ball valve 32 and the unexposed nature of the mechanism increase its reliability and lessens the need for maintenance.

The operating section 39 and the air tank 41 are installed on the ground. They serve to provide pressurized air to both the valve assembly 29 and the foam leak detection system 45, shown in FIG. 1. Reinforcing brackets 44 are provided to stabilize various pipes in the extinguishing system. The air supply pipe line 40 connects the pressurized air cylinder 41 to the operating section 39 and the pneumatic cylinder 38. The operating section 39 is used to select the pathway of the pressurized gas from tank 41. The pressure regulator 50 is used to regulate the pressure of the gas as it leaves the cylinder 41.

An open/closed indicator 42 is mounted at the end of the valve shaft 37 directly connected to the pneumatic cylinder 41. Turning the valve shaft opens or closes the valve path to change the pointer of the indicator by 90 degrees. This allows the flow direction of the foam to be confirmed visually from the ground. In FIGS. 1 and 6, the valve path is provided which discharges the foam into the test pipeline 35, as can be predicted by the open/closed indicator 42, and then into the foam collector 43. This testing method allows direct observation of the quality and amount of foam produced by any given unit. Additionally, direct observation of sample foam allows an opportunity to check for any contamination. Such a finding can indicate that the strainer 26 may be functioning improperly.

A foam leak detection system 45 is also provided. This system ensures the detection of the potential of foam leakage into the oil tank by pressure gauges before the extinguishing system function test is carried out. This test represents a duplicated checking method which ensures the complete maintenance of the system.

The pipe 47 connects the testing pipeline 35 and the operating section 39. The operating section selector switch 39 is set to admit pressurized air from cylinder 41 to pipe 47 during the foam leak detection process. Selection valve 49 is used to seal off the test pipe line 35 from foam collector 43. A given pressure is then provided in the test pipe line 35 by the pressurized air reservoir 41 via the air line 47. The pressure gage 46 is opened to the test pipeline 35 by selective valve 48. A reading is taken from pressure gauge 46. If the 3-way ball valve 32 is not fully closed in this prefoaming test procedure, the pressure gauge 46 will indicate a pressure of something less than that provided. The baseline pressure is established by pressure regulator 50 before the test is started. By moving the select valve 30 to the non-testing position, the location of the leak can be localized. That is, if the pressure in the testing pipeline 35 is still low, the leak may be only in the testing pipeline 35.

The foam leak detection system provides several advantages. It indicates whether the system has leaked in general. Furthermore, it assures that the oil tank 1 will not be accidentally contaminated during the actual foam testing procedure. It also serves to protect the reliability of the maintenance system of the present invention.

The above exemplification of the inventive concept is merely one possible embodiment of the present invention. However, the method can be easily applied and modified to fit the needs of any number of specific applications. The extinguishing system function test device may, for example, be designed with gears at the valve shaft, around which chains are mounted to open and close the 3-way valve.

I claim:

1. A fire extinguishing assemblage for oil tanks comprising:

A. a foam chamber means for producing extinguishing foam;

B. a first supply line for admitting a mixture of air and extinguishant to said foam chamber;

C. a second supply line for admitting said extinguishing foam from said foam chamber to the oil tank;

D. a sealing cap within said foam chamber for sealing the end of said first supply line as will automatically open when the pressure in said first supply line reaches a predetermined value and will automatically reseal said first supply line when the pressure in said first supply line falls below said predetermined value;

E. an emergency test means for remotely testing the emergency readiness of the fire extinguishing assemblage, said means comprising:

(a) a remotely operated 3-way valve means within said second supply line as can be selectively set to direct extinguishing foam from said foam chamber to either the oil storage tank or a foam collector independent of said oil tank through a foam collector line; and (b) control mean for remotely operating said 3-way valve means; and F. a leak detector means for testing the effectiveness of said sealing cap, said leak detector means comprising;

(a) means for admitting compressed gas to said foam chamber at a predetermined pressure; and (b) mean for determining the gaseous pressure in said foam chamber.

2. The fire extinguishing assemblage of claim 1 in which said leak detector means comprises:

(a) means for admitting compressed gas to said foam collector line;

(b) a valve means on said foam collector line as can be selectively closed to prevent said gas from entering said foam collector but instead entering said foam chamber via said 3-way valve means;

(c) a first pressure gauge on said means for admitting compressed gas to said foam collector line; and (d) a second pressure gauge on said foam collector line which will indicate a leak in said sealing cap when said second pressure gauge indicates a lower pressure than the pressure indicated by said first pressure gauge.

3. The fire extinguishing assemblage of claim 1 in which said sealing cap is fabricated of metal and has a ring-shaped Teflon seal and asbestos packing to avoid any sparking when the sealing cap is opened or closed.

4. The fire extinguishing assemblage of claim 2 in which said sealing cap is provided with a plurality of guide bars extending downward into said first supply line and are connected to a ring shaped connecting rod to suppress any swing which may be generated by the vertical motion of said sealing cap.

5. The fire extinguishing assemblage of claim 1 in which said 3-way valve means is pneumatically operated.

6. The fire extinguishing assemblage of claim 1 wherein an indicator means is provided to indicate whether said 3-way valve is opened to the oil tank or to the foam collector.

7. The fire extinguishing assemblage of claim 1 in which said foam collector, control means and all of said valves are at ground level to thereby permit all testing from the ground level.

8. The foam chamber of claim 1, wherein an indicator means is provided to indicate the sealing cap's open or closed position by visual observation from a remote location.

* * * * *